US006585283B2

(12) United States Patent
Merino et al.

(10) Patent No.: US 6,585,283 B2
(45) Date of Patent: Jul. 1, 2003

(54) ELEMENT FOR RETAINING THE FRONT PORTION OF A BOOT ON A SKI

(75) Inventors: Jean-François Merino, Epagny (FR); Philippe Miette, Annecy le Vieux (FR); Daniel Soldan, Seynod (FR); Gilles Renaud-Goud, Gruffy (FR); Pascal Thomas, Chambery (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/842,782

(22) Filed: Apr. 27, 2001

(65) Prior Publication Data

US 2001/0038194 A1 Nov. 8, 2001

(30) Foreign Application Priority Data

May 4, 2000 (FR) ..... 00 05831

(51) Int. Cl.[7] ..... A63C 9/08
(52) U.S. Cl. ..... 280/634; 280/625
(58) Field of Search ..... 280/607, 611, 280/623, 626, 631, 632, 633, 634

(56) References Cited

U.S. PATENT DOCUMENTS

| | | | | | |
|---|---|---|---|---|---|
| 3,893,685 | A | * | 7/1975 | Svobada | 280/634 |
| 3,964,757 | A | * | 6/1976 | Sittmann | 280/634 |
| 4,372,574 | A | * | 2/1983 | Svoboda et al. | 280/634 |
| 4,765,641 | A | * | 8/1988 | Peyre | 280/634 |
| 4,940,253 | A | * | 7/1990 | Brischoux | 280/634 |
| 4,979,762 | A | * | 12/1990 | Gallet | 280/634 |
| 4,989,893 | A | * | 2/1991 | Kowatsch et al. | 280/611 |
| 5,040,821 | A | | 8/1991 | Berthet et al. | 280/625 |
| 5,050,902 | A | * | 9/1991 | Bouque et al. | 280/634 |
| 5,092,621 | A | * | 3/1992 | Horn | 280/634 |
| 5,121,939 | A | * | 6/1992 | Peyre | 280/634 |
| 5,527,058 | A | * | 6/1996 | Janisch et al. | 280/634 |
| 5,558,356 | A | * | 9/1996 | Challande et al. | 280/634 |
| 5,639,108 | A | * | 6/1997 | Challande et al. | 280/607 |
| 5,695,211 | A | * | 12/1997 | Challande et al. | 280/634 |
| 5,722,679 | A | | 3/1998 | Challande et al. | 280/612 |
| 5,722,681 | A | * | 3/1998 | Merino et al. | 280/634 |
| 5,785,343 | A | * | 7/1998 | Challande et al. | 280/634 |

FOREIGN PATENT DOCUMENTS

| | | |
|---|---|---|
| EP | 0739646 | 10/1996 |
| EP | 0785002 | 7/1997 |
| EP | 0785003 | 7/1997 |
| EP | 0807453 | 11/1997 |
| EP | 0807454 | 11/1997 |
| EP | 0820331 | 9/1998 |
| FR | 2624387 | 6/1989 |
| FR | 1503847 | 12/1997 |
| FR | 1503848 | 12/1997 |
| FR | 1503849 | 12/1997 |

OTHER PUBLICATIONS

U.S. patent application No. 09/842,781 (Merino et al.), filed on Apr. 27, 2001.

* cited by examiner

*Primary Examiner*—Brian L. Johnson
*Assistant Examiner*—Christopher Bottorff
(74) *Attorney, Agent, or Firm*—Greenblum & Bernstein, P.L.C.

(57) ABSTRACT

An element for retaining a boot on a skid, the retention element including a base provided to be affixedly connected to the ski, overlaid by a body, a jaw having two independent retaining wings journalled to the body about a vertical axle, the wings having, beyond their journal axle, a tip exerting an action by pressure on the head of a movable tie rod biased by a spring. A rocker, journalled with respect to the base, is inserted between the tips and the head of the tie rod, the tips being in support against an arm of the rocker, and the rocker being mounted asymmetrically with respect to the base or the tips.

7 Claims, 3 Drawing Sheets

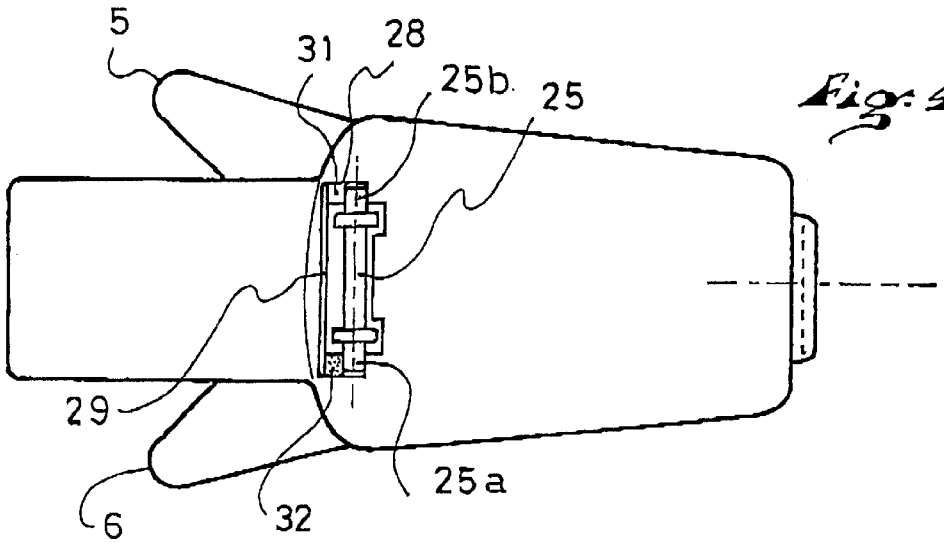
Fig: 4
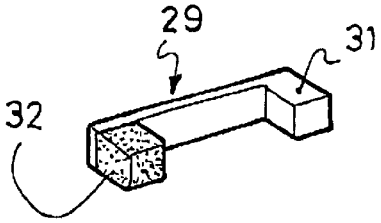
Fig: 5
Fig: 6
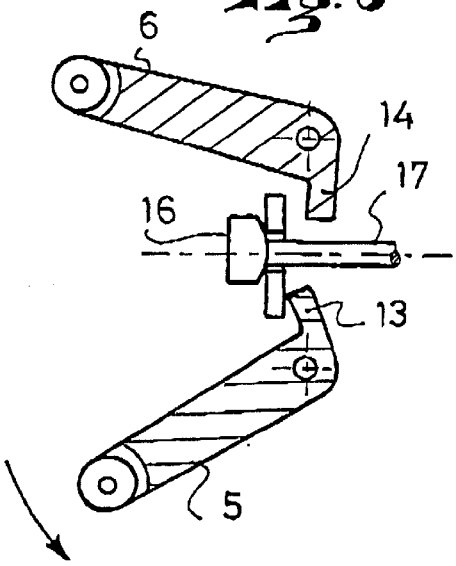
Fig: 7
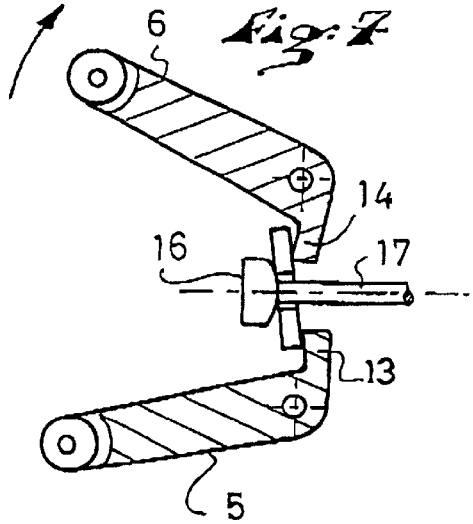

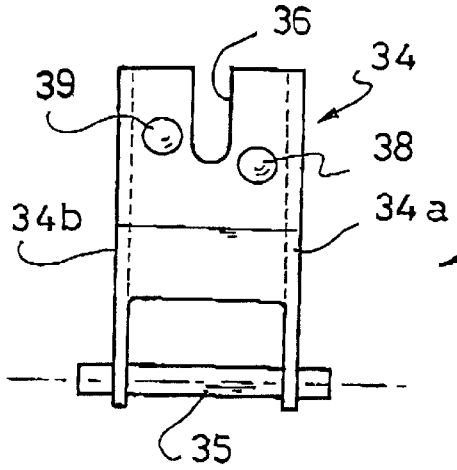
Fig: 8
Fig: 9
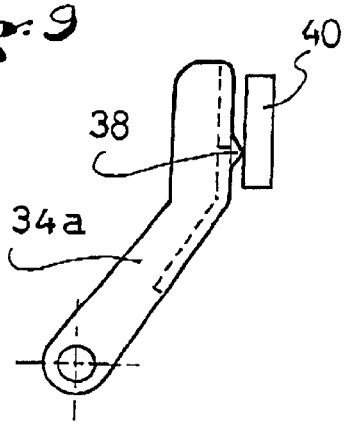
Fig: 10
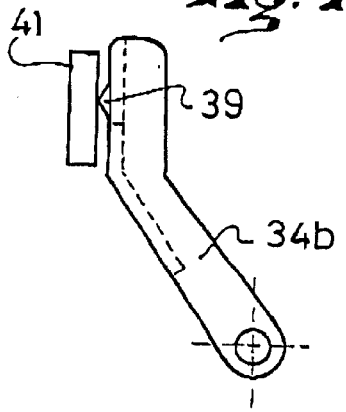
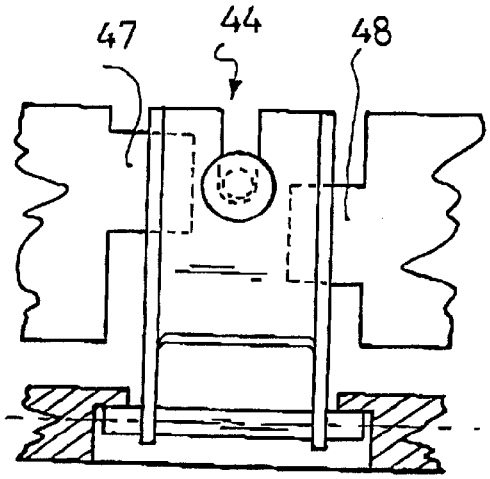
Fig: 11

ELEMENT FOR RETAINING THE FRONT PORTION OF A BOOT ON A SKI

BACKGROUND OF THE INVENTION

1. Field of the Invention

The present invention relates to an element for retaining the front portion of a boot on a ski, i.e., a front ski binding.

More specifically, the invention relates to a retaining element with asymmetrical release, i.e., whose parameters for releasing the boot are different depending on the direction in which the boot biases the retaining jaw.

2. Description of Background and Relevant Information

In a known fashion, a front retaining element includes a retaining jaw that is maintained in a centered position on the ski by an elastic return device. In response to the forces exerted by the boot, the jaw is capable of moving laterally from either side of this aligned position until enabling the release of the boot.

It is also known that a skier's knee can withstand a higher torsional force of the leg if the foot is driven outward; conversely, the knee is more fragile if the foot is driven toward the other foot. These torsional forces translate into a lateral force exerted by the front potion of the boot on the jaw.

To take this into account, constructions of a front retaining element with asymmetrical release have been proposed. Such constructions have been disclosed in particular in the patent documents FR 1 503 847, FR 1 503 848, FR 1 503 849, EP 785 002, EP 785 003, and EP 807 454.

SUMMARY OF THE INVENTION

An object of the invention is to provide a new mode of construction of an element for retaining the front portion of a boot which has an asymmetrical lateral release mode of operation.

This new mode applies to a construction of a front retaining element which has a fixed body and independent wings. A retaining element of this general type is disclosed in patent document FR 2 624 387 and in U.S. Pat. No. 5,040,821, the disclosures of which are incorporated by reference thereto in their entireties. In general, this element includes a body provided to be immobilized on the ski, in the longitudinal direction which it defines, and two independent wings journalled to the body about a substantially vertical axle. Each of the wings is engaged on a tie rod or a movable piston that acts on a return spring.

An object of the invention is to propose a simple modification of this construction which renders its functioning mode asymmetrical.

The retaining element according to the invention includes a base provided to be affixedly connected to the ski, overlaid by a body, a jaw having two independent retaining wings journalled to the body about a vertical axle, the wings having, beyond their journal axle, a tip exerting an action by pressure on the head of a movable tie rod biased by a spring.

The element includes a rocker, journalled relative to the base, inserted between the tips and the head of the tie rod, the tips being in support against an arm of the rocker, and the rocker being mounted asymmetrically with respect to the base or the tips.

A general feature of the invention is the insertion of a journalled element between the tips and the tie rod and to play with the lever arms with which this journalled element transmits to the tie rod the forces which it receives from either one of the tips.

BRIEF DESCRIPTION OF DRAWINGS

The invention will be better understood from the description that follows, with reference to the annexed drawings, in which.

FIG. 4 shows a bottom view of the retaining element of FIG. 1;

FIG. 5 shows a perspective view of the wedge for holding the rocker;

FIGS. 6 and 7 are schematic views that show the functioning of the device of FIG. 1;

FIG. 8 shows a front view of the rocker made according to another embodiment of the invention;

FIGS. 9 and 10 show the functioning mode of the rocker of FIG. 8;

FIG. 11 relates to another embodiment of the invention.

DETAILED DESCRIPTION OF THE INVENTION

Figure 1:
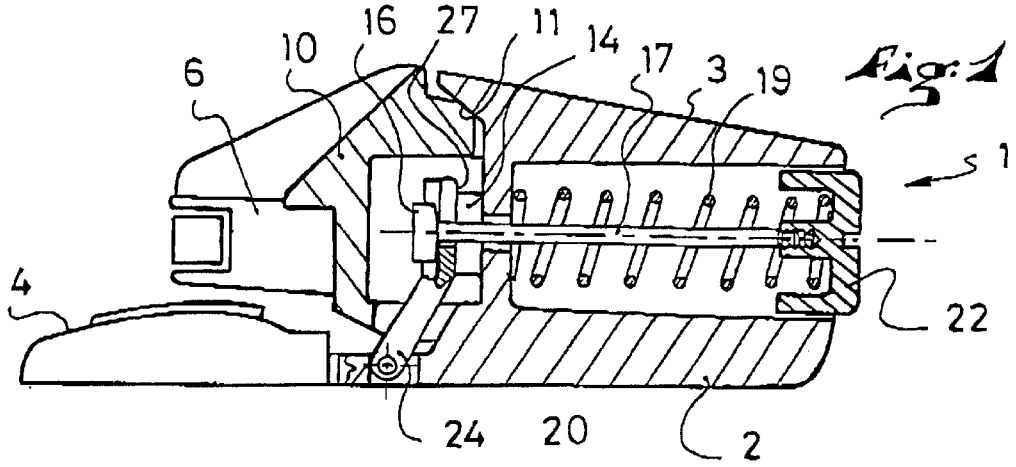
FIG. 1 shows a side partial cross-sectional view of a retaining element according to a first embodiment of the invention.
Figure 2:
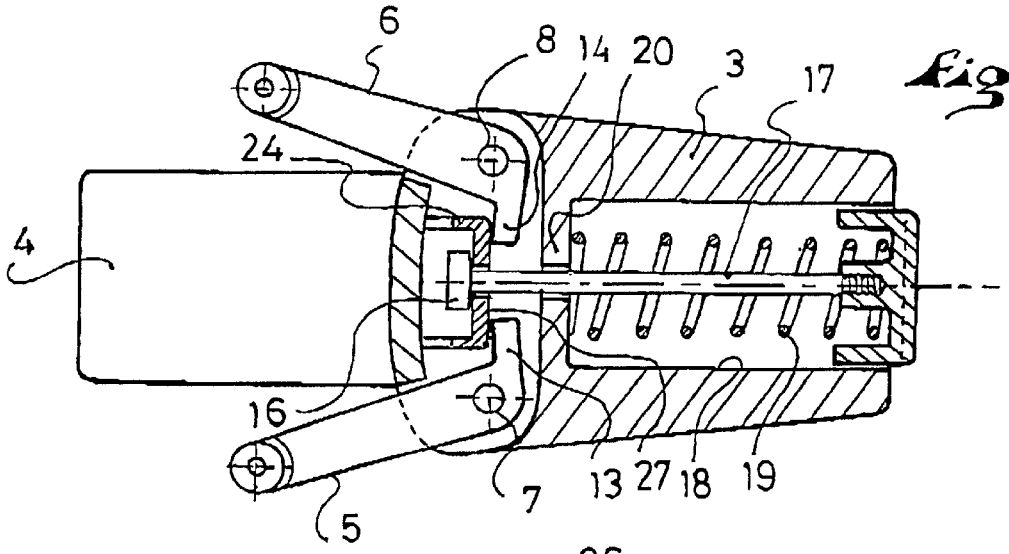
FIG. 2 is a top partial cross-sectional view of the retaining element of FIG. 1.

The retaining element 1 that is shown in FIG. 1 includes a base 2 overlaid by a body 3. The base is provided to be affixedly connected to the ski, for example, by screws. It is extended rearwardly by a support element 4 provided to receive the boot.

Two wings 5 and 6 are mounted on the body; they are rotationally movable about substantially vertical axles 7 and 8. The wings form the jaw for retaining the boot.

According to the embodiment shown, the axles of the wings are in fact borne by a plate 10 attached to the rear of the body. The plate is in support against the remainder of the body, and it is capable of tilting upward about an upper support 11, in response to an upward vertical bias exerted on the wings of the jaw.

Beyond their journal axle, each of the wings has a tip 13, 14, respectively, that is oriented toward the vertical median plane defined by the body. However, the tips are at a distance from this plane.

The tips are connected to the head 16 of a tie rod 17 housed in a recess 18 of the body. The tie rod is movable in the vertical median plane, approximately along a longitudinal direction. Preferably, the tips are located in the area of the axis of the tie rod or above.

A spring 19 is mounted in the recess 19. One end of the spring is in support against a wall 20 of the body demarcating the rear of the recess 19. The other end of the spring is retained by a cap 22 screwed at the end of the tie rod 17 and guided into the recess 19 of the body. The cap also makes it possible to adjust the initial compression of the spring.

Other constructions of mounting the tie rod and the spring could also be used.

According to the invention, a journalled rocker 24 intervenes between the tips and the head of the tie rod. The rocker is journalled at its base with respect to the base 2 of the element about a pivoting axle 25. Its upper arm 27 is inserted between the tips 13 and 14 and the head of the tie rod, i.e., the tips are in support against the upper arm of the rocker, which is itself in support against the head of the tie rod.

Figure 3:
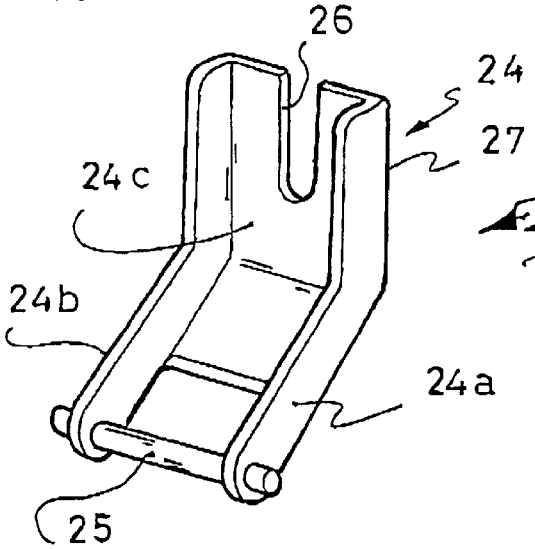
FIG. 3 shows a perspective view of the connecting rocker.

As shown in FIG. 3, for example, the rocker is an element made of sheet metal with a U-shaped cross-section. The pivoting axle is housed at the base of the tie rod in the lateral walls 24*a* and 24*b* of the U-shape. The bottom wall 24*c* has in its upper portion a cutout 26 that is provided to be crossed through by the body of the tie rod 17 and to retain the head 16 of the tie rod.

FIG. 4 shows the retaining element in a bottom view and shows the housing 28 provided for the pivoting axle 25. The housing, which retains the axle along an upward vertical direction, is further provided to retain the axle 25 with a clearance along a longitudinal direction.

A wedge or spacer 29 controls the longitudinal clearance of the two ends of the axle 25 in its housing.

The wedge 29 reduces the clearance of one end of the axle 25 to an operational clearance and permits a longitudinal rearward displacement of the other end. For example, as shown in FIG. 5, the wedge is made of plastic having, on one side, a hard stud 31 obtained in the block, and, on the other side, an attached stud 32 made of foam, elastomer, viscoelastic material, or any other elastically deformable material. Other constructions of the wedge could also be used, as long as one end of the axle 25 is held without longitudinal clearance in its housing, and the other end is held with a free or elastic clearance. Advantageously, the wedge 29 is reversible, i.e., it can be assembled to the base in two different ways, with the deformable stud on either side of the retaining element. This simplifies the construction of the element. One could also do without the wedge and control the displacement of the two ends of the axle solely by the dimensions of the housing Furthermore, the deformable stud is optional, and the space of the housing where the end of the axle is capable of moving with a clearance could be left free, The retaining element functions in the following manner. In the absence of a biasing force, the tie rod applies the rocker against the tips, and its pivoting axle 25 in abutment by its two ends against the front portion of the housing 28.

With reference to FIG. 6, when the wing 5 located on the side of the hard stud 31 opens, in reaction to the forces exerted by the tip 13 and the head 16 of the tie rod, the rocker pivots about its axle 25 by taking support mainly on the end 25*b* of this axle. As the longitudinal clearance of this end is reduced to the operational clearance by the hard stud 31, the rocker pivots normally, and the longitudinal component of the movement of the wing is transmitted by the rocker to the head of the tie rod.

Referring now to FIG. 7, if it is the wing 6 that opens, the axle 25 of the rocker takes support by its end 25*a* against the deformable stud 32 that permits a controlled displacement of the end 25*a* of the axle. The rocker is then askew as shown in FIG. 7, and reduces the displacement of the tie rod relative to the longitudinal movement of the tip 14. Under these conditions, the wing 6 is capable of opening more easily than the wing 5, i.e., for a less intense bias. Preferably, as is visible in the Figures, the bottom of the head of the tie rod is curved to facilitate the rotational movement of the rocker with respect to the head of the tie rod.

It is to be understood that for the other front element mounted on the other ski of the pair, the relative position of the hard and deformable studs is inverted so that the retaining elements have a symmetrical functioning one with respect to the other.

Advantageously, it is possible to construct the two elements of a pair with the same elements. The symmetrical functioning can indeed be obtained by simply reversing the edge 29 that can be mounted in two different positions. Furthermore, it is possible to play with the static and/or dynamic hardness of the deformable stud 32 to control the movement by which the stud is positioned askew, in terms of speed and range.

FIGS. 8–10 relate to an alternative embodiment of the invention.

According to this variation, one plays with the lever arm with which each tip biases the additional rocker.

FIG. 8 shows a front view of a rocker 34 which is of the same type as the previous rocker 24, except the constructional differences which will be described subsequently. In particular, the rocker 34 has two wings 34*a*, 34*b*, and a bottom wall 34*c* with a cutout 26 for the tie rod.

The rocker is mounted in the base of the retaining element as the preceding rocker 24; however, only an operational clearance is provided in the area of the housing of the axle 35.

According to the embodiment shown, in the area of the tips, the bottom wall has two bosses 38 and 39 located at different distances from the axle 35. Each of the bosses is provided to receive the support of a tip. Thus, the lever arms with which the wings bias the rocker are different.

FIG. 9 shows the tip 40 in support against the boss 38. In the same manner, FIG. 10 shows the tip 41 in support against the boss 39. Since the lever arm is longer in this latter case, the wing associated with the tip 41 will open mole easily than the other.

The rocker of the retaining element associated with the other ski of a pair of skis would have a rocker with an inverted relative position of the studs. To obtain a symmetrical functioning of the two retaining elements of a pair, it is necessary here to construct these elements with different rockers, one being provided for a right element, the other for a left element.

FIG. 11 shows an alternative embodiment. According to this variation, it is the tips themselves that are located at a different distance from the axle of the rocker.

Thus, FIG. 11 shows a rocker 44 journalled about an axle 45 and biased by two tips 47 and 48 that are located at a different distance with respect to the axle 45.

The present description is provided for guidance only, and other embodiments of the invention could be adopted without leaving the scope thereof.

The instant application is based upon the French Patent Application No. 00 05831, filed May 4, 2000, the disclosure of which is hereby incorporated by reference thereto in its entirety, and the priority of which is hereby claimed under 35 U.S.C. §119.

What is claimed is:

1. An element for retaining a boot on a ski, said retention element comprising:

a base adapted to be affixed to the ski;

a body supported on said base; a tie rod mounted for movement with respect to said base, said tie rod having a head;

a spring mounted for exerting an elastic pressure against said head of said tie rod;

a jaw having two independently movable retaining wings journalled to said body about a vertical axis, each of said wings having, beyond their respective journal axes, a tip to exert a pressure on said head of said movable tie rod;

a rocker journalled relative to said base, said rocker being positioned between said tips of said wings and said head of said tie rod, said tips being in support against an arm of said rocker, and said rocker being asymmetrically arranged with respect to said base or with respect to said tips;

said rocker being journalled to said base by means of an axle, said axle having a pair of opposed ends, said ends being housed in a housing, one of said ends of said axle having a reduced longitudinal operational clearance, and a second of said ends of said axle being mounted to move longitudinally.

2. A boot-retention element according to claim 1, further comprising a wedge having a hard stud on a first side and a deformable stud on a second side, said wedge being positioned in said housing and controlling longitudinal clearance of said ends of said axle.

3. A boot-retention element according to claim 2, wherein said wedge is reversible and has two mounting positions in said housing of said base.

4. A boot-retention element according to claim 2, wherein said deformable stud is made of elastomer.

5. A boot-retention element according to claim 2, wherein said deformable stud is made of a viscoelastic-material.

6. A boot-retention element according to claim 1, wherein said rocker is mounted to tilt about an axle housed in said base, and wherein said tips are supported on said rocker at different distances from said axle.

7. A boot-retention element according to claim 6, wherein said rocker has two bosses located at different respective distances from said axle, against which said tips are in support.

* * * * *